US010060202B2

(12) United States Patent
Folk

(10) Patent No.: US 10,060,202 B2
(45) Date of Patent: Aug. 28, 2018

(54) SYSTEM AND METHOD FOR DELIVERING A TUBULAR PIPE SEGMENT TO A DRILL RIG FLOOR

(71) Applicant: COAX Technology Inc., Edmonton (CA)

(72) Inventor: Robert Folk, Edmonton (CA)

(73) Assignee: COAX Technology Inc., Edmonton, Alberta (CA)

( * ) Notice: Subject to any disclaimer, the term of this patent is extended or adjusted under 35 U.S.C. 154(b) by 0 days.

(21) Appl. No.: 15/191,321

(22) Filed: Jun. 23, 2016

(65) Prior Publication Data

US 2017/0096867 A1 Apr. 6, 2017

Related U.S. Application Data

(60) Provisional application No. 62/184,126, filed on Jun. 24, 2015.

(51) Int. Cl.

| | |
|---|---|
| ***E21B 19/15*** | (2006.01) |
| ***E21B 19/16*** | (2006.01) |
| ***E21B 15/00*** | (2006.01) |

(52) U.S. Cl.

CPC ..... *E21B 19/155* (2013.01); *E21B 15/00* (2013.01); *E21B 19/16* (2013.01)

(58) Field of Classification Search

CPC ..... E21B 19/155; E21B 19/15; E21B 19/20; E21B 19/14; E21B 19/16; Y10T 82/2514; Y10T 408/381; B23Q 1/76; B23Q 7/003; B23Q 7/042; B23G 1/22; B23G 1/52; Y10S 470/901

USPC ..... 144/245.2, 250.25; 166/378, 379, 380, 166/77.51, 85.5; 198/369.3, 782, 818; 228/44.5; 269/289 MR; 29/282; 405/170; 414/14–18, 22.51–22.59, 414/22.61–22.68, 746.5, 746.6, 746.7, 414/746.8; 72/251, 422

See application file for complete search history.

(56) References Cited

U.S. PATENT DOCUMENTS

| | | | | | |
|---|---|---|---|---|---|
| 662,917 | A * | 12/1900 | Daschbach | B21B 39/04 | 198/782 |
| 1,922,913 | A * | 8/1933 | Free | B23K 11/0935 | 219/59.1 |
| 2,034,451 | A * | 3/1936 | Percival | B23K 37/0538 | 219/158 |
| 2,108,274 | A * | 2/1938 | Tautz | B23B 13/00 | 414/18 |
| 3,315,822 | A * | 4/1967 | Hart | E21B 19/15 | 175/85 |
| 3,348,678 | A * | 10/1967 | Flowers | B07C 5/22 | 198/369.3 |

(Continued)

*Primary Examiner* — Gregory W Adams
(74) *Attorney, Agent, or Firm* — Stephen M. De Klerk

(57) ABSTRACT

A system for delivering a tubular pipe segment from a ground level to an elevated drill rig floor. A pipe assembly system based at the ground level includes a bucking unit for connecting a first joint and a second joint to form the tubular pipe segment, a powered first conveyor for moving the first joint into the bucking unit, a first staging pipe rack, a powered second conveyor for moving the second joint into the bucking unit, and reversible for moving the tubular pipe segment out of the bucking unit, a second staging pipe rack for storing a plurality of joints, and a transfer pipe rack for storing a plurality of tubular pipe segments.

18 Claims, 9 Drawing Sheets

(56) References Cited

U.S. PATENT DOCUMENTS

| | | | | | |
|---|---|---|---|---|---|
| 3,458,055 | A * | 7/1969 | Council | B65G 17/063 | 414/746.2 |
| 3,587,822 | A * | 6/1971 | White | B65G 47/04 | 198/463.5 |
| 3,745,319 | A * | 7/1973 | Unigovsky | B23K 37/08 | 219/101 |
| 4,417,363 | A * | 11/1983 | Lee, Jr. | B23G 1/22 | 82/124 |
| 4,465,422 | A * | 8/1984 | Blust, Sr. | B23Q 1/76 | 408/45 |
| 4,516,306 | A * | 5/1985 | Albert | B23Q 1/76 | 29/33 T |
| 4,907,732 | A * | 3/1990 | Jones | B23K 31/027 | 198/300 |
| 5,070,989 | A * | 12/1991 | Brown | B27B 1/007 | 144/245.2 |
| 6,705,414 | B2 * | 3/2004 | Simpson | E21B 15/003 | 175/52 |
| 7,163,367 | B2 * | 1/2007 | Handley | E21B 19/155 | 405/166 |
| 7,967,540 | B2 * | 6/2011 | Wright | E21B 19/20 | 166/377 |
| 7,992,646 | B2 * | 8/2011 | Wright | E21B 19/155 | 166/379 |
| 8,469,085 | B2 * | 6/2013 | Orgeron | E21B 19/155 | 166/77.51 |
| 8,936,424 | B1 * | 1/2015 | Barnes | E21B 19/02 | 414/22.63 |
| 9,038,509 | B1 * | 5/2015 | Wroble | B23G 11/00 | 82/117 |
| 2007/0221385 | A1 * | 9/2007 | Braun | E21B 19/155 | 166/379 |
| 2014/0093347 | A1 * | 4/2014 | Thomas | E21B 37/00 | 414/800 |

* cited by examiner

SYSTEM AND METHOD FOR DELIVERING A TUBULAR PIPE SEGMENT TO A DRILL RIG FLOOR

CROSS REFERENCE TO RELATED APPLICATION

This application claims priority to U.S. Provisional Application No. 62/184,126 filed Jun. 24, 2015 entitled "SYSTEM AND METHOD FOR DELIVERING A DRILL PIPE SEGMENT TO A DRILL RIG FLOOR", the contents of which are incorporated herein by reference.

FIELD

The field of the invention relates to systems and methods for delivering tubular joints from a ground level to an elevated drill rig floor, and in particular to a system and method that is suited to delivering a tubular pipe segment made of two or more joints of standard length.

BACKGROUND

A typical land-based drilling rig has a rig floor that is elevated from the ground level. In order to "make-up" the drill pipe, segments of the drill pipe ("joints") must be delivered from the ground level to the rig floor. In the conventional system for delivering the joints from the ground level to the rig floor, joints are delivered individually using a catwalk or slide with an inclined delivery platform. Once delivered to the rig floor, workers align each joint vertically over the top end of the drill pipe and use manual tools such as clamps and rotary wrenches, or an iron roughneck machine, to connect the joint to the drill pipe using threaded end connections.

One limitation of the conventional system is that the length of the delivery platform is typically suited for delivering only one joint having a standard length of about 28 to 32 feet (8.5 to 9.8 meters) (commonly referred to as a "Range #2 tubular") or 44 feet to 48 feet (13.4 to 14.6 meters) (commonly referred to as a "Range #3 tubular"). Another limitation is that each joint that is delivered to the rig floor must be individually connected to the drill pipe at the rig floor by roughnecking operations. As the number of joints increases, so too does the number of delivery cycles required of the catwalk (thus increasing the time required to makeup the drill string) and the number of roughnecking operations (thus increasing the risk of making a "bad joint" at the rig floor and the risk of personal injury to workers).

Accordingly there is a need for a system and a method for delivering a tubular pipe segment comprising multiple joints from a ground level to an elevated rig floor.

BRIEF DESCRIPTION OF THE DRAWINGS

In the drawings, like elements are assigned like reference numerals. The drawings are not necessarily to scale, with the emphasis instead placed upon the principles of the present disclosure. Additionally, each of the embodiments depicted are but one of a number of possible arrangements utilizing the fundamental concepts of the present disclosure. The drawings are briefly described as follows.

DETAILED DESCRIPTION OF PREFERRED EMBODIMENTS

This disclosure relates to a system and method for delivering a tubular pipe segment from a ground level to an elevated rig floor. When describing the present disclosure, all terms not defined herein have their common art-recognized meanings. To the extent that the following description is of a specific embodiment or a particular use of the invention, it is intended to be illustrative only, and not limiting of the claimed invention.

In this description, the term "joint" shall refer to any type of oilfield pipe or tubular used in conjunction with drilling, servicing or production operations of a wellbore, including without limitation, drill pipe, drill collars, pup joints, bottom hole assemblies (BHA's), casing, production tubing. As is well known in the art, a joint typically has a threaded end connection, such as a coupling ring, for connecting the joint in end-to-end relationship with another joint. The term "standard length" in describing the length of a joint shall refer to a length of about 28 to 32 feet (8.5 to 9.8 meters) (commonly referred to as a "Range #2 tubular") and a length of about 44 to 48 feet (13.4 to 14.6 meters) (commonly referred to as a "Range #3 tubular"). The term "tubular pipe segment" shall refer to at least two joints connected together by their threaded end connections. It will be understood that the present disclosure is not limited by the tubular pipe segment's number of constituent joints or the length of those joints, unless expressly indicated. In embodiments disclosed, the tubular pipe segment may include three of Range #2 tubulars (i.e. 3×28 to 32 feet, being 84 to 96 feet), or two of Range #3 tubulars (i.e. 2×44 to 48 feet, being 88 to 96 feet). The length of the assembled segments are practically limited by hoisting ability of the rig, i.e. a "triple" is about 90 to 100 feet. The system of the present disclosure will now be described having regard to the accompanying Figures.

Figure 1:
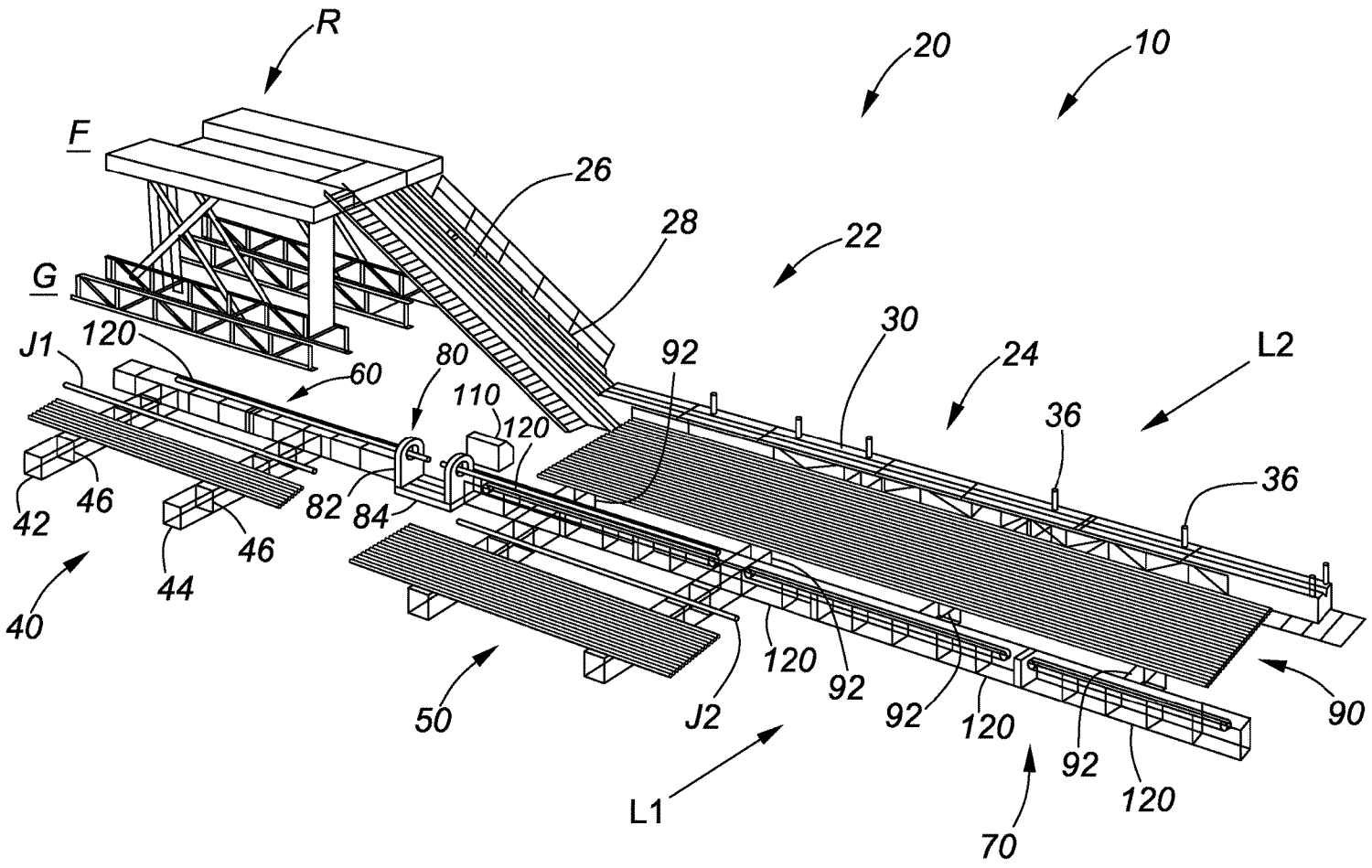
FIG. 1 is a perspective view of one embodiment of the system of the present disclosure with the catwalk in the loading configuration.
Figure 2:
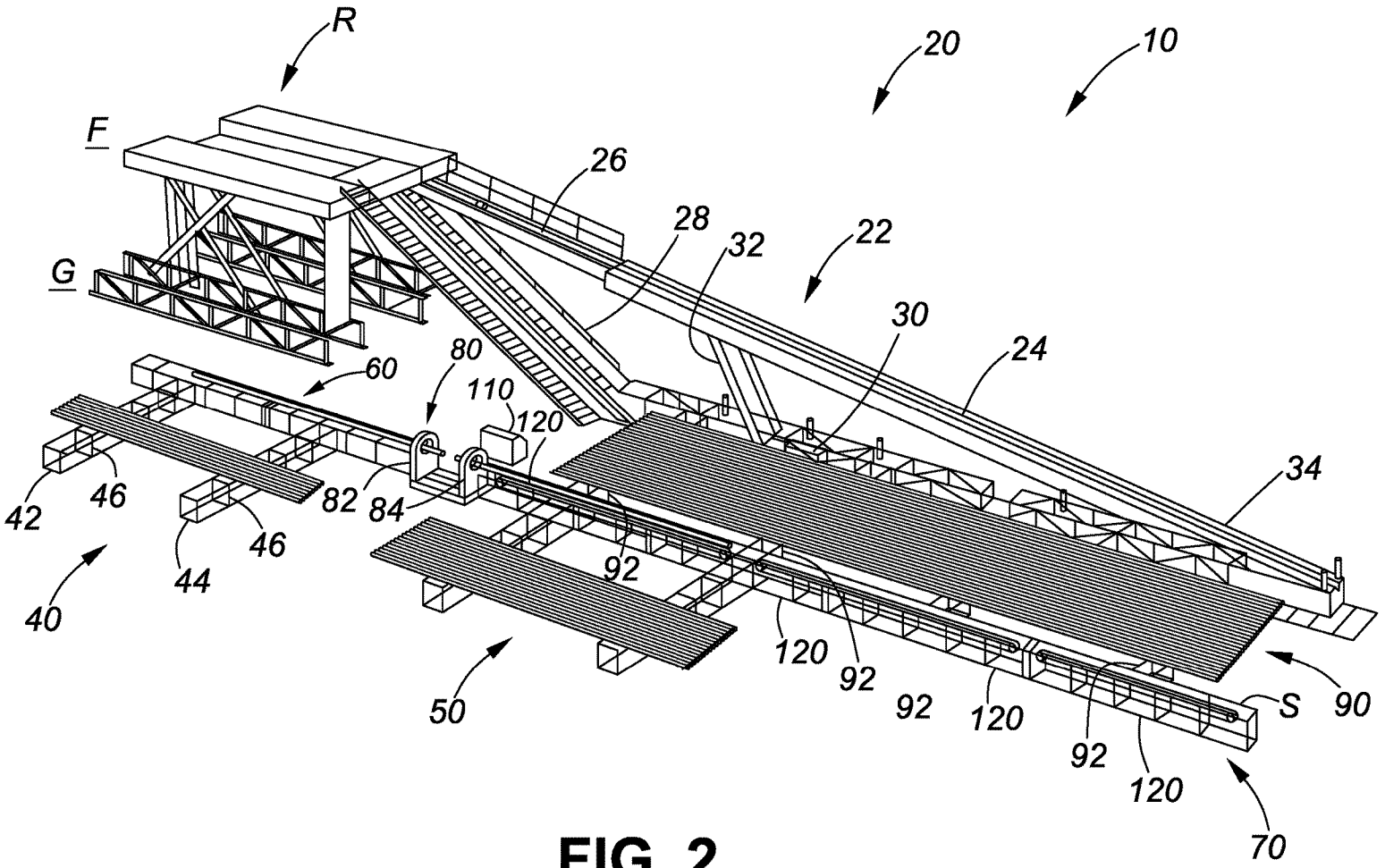
FIG. 2 is a perspective view of the embodiment of the system shown in FIG. 1, with the catwalk in the delivery configuration.

FIGS. 1 and 2 show one embodiment of the system (10) comprising a powered delivery skate or conveyor (34), a first staging pipe rack (40), a second staging pipe rack (50), a first conveyor (60), a second conveyor (70), a bucking unit (80), a transfer pipe rack (90) and a controller (110). The system (10) is used in conjunction with a drilling rig (R) having a rig floor (F). In FIGS. 1 and 2, the derrick and other components of the rig (R) are omitted for clarity.

The powered delivery skate or conveyor (34) moves the tubular pipe segment (S) along an incline extending from the ground level (G) to the rig floor (F), in both directions. In one embodiment, the delivery skate or conveyor (34) may be provided as part of a catwalk (20), but it will be understood that the powered delivery skate or conveyor (34) may be provided apart from a catwalk (20). In the embodiment shown in FIGS. 1 and 2, the catwalk (20) is an apparatus as described in PCT international patent application published as WO 2013/123602A1, the entire contents of which are hereby incorporated by reference. The delivery skate or conveyor (34) comprises a loading portion (24) and a slide portion (26), which are pivotally connected to each other and to a support frame (28). In one embodiment, the delivery conveyor (34) has a length of least about twice a joint of standard length. In one embodiment, the delivery conveyor (34) has a length of at least about 60 feet (18 meters), and preferably at least about 95 feet (29 meters). Initially, the catwalk (20) is in a loading configuration as shown in FIG. 1 in which the loading portion (24) is substantially horizontal and located at ground level. A hydraulically actuated piston (30) or an electrically powered device drives a strut (32) which lifts the loading portion (24) and the slide portion (26) into a delivery configuration as shown in FIG. 2 in which the loading portion (24) and the slide portion (26) are aligned to form a single inclined delivery platform (22) extending from the ground level (G) to the rig floor (F). When the catwalk (20) is in the delivery configuration, the powered delivery skate or conveyor (34) lifts the tubular pipe segment (S) along the delivery platform (22). In embodiments, the catwalk (20) may have pins (at the perimeter of the loading portion (24) that may be selectively raised and lowered to prevent or allow the movement of a tubular pipe segment (S) from the transfer pipe rack (90) onto the loading portion (24). In embodiments, the catwalk (20) may also have hydraulically actuated kickers (not shown) and indexers (not shown) positioned to selectively prevent the tubular pipe segment from entering the path of the powered delivery skate or conveyor (34), or move the tubular pipe segment out of the path of the powered delivery skate or conveyor (34). As is known in the art, when used in multi-pad drilling, a fully assembled drilling rig (R) with its catwalk (20) can be moved between drilling pads using hydraulic walking or skidding systems.

The first staging pipe rack (40) and the second staging pipe rack (50) support a plurality of first joints (J1) and second joints (J2), respectively, until they are ready to be made up into tubular pipe segments (S) by the bucking unit (80). In one embodiment as shown in the Figures, the first staging pipe rack (40) comprises two framed beam members (42, 44) that are spaced apart and substantially parallel to each other and oriented substantially perpendicularly to the first conveyor (60). The spacing between the beam members (42, 44) may be selected to support at least a joint (J1) of standard length resting across the top of the beam members (42, 44). The beam members (42, 44) are inclined downwards towards an end that abuts the first conveyor (60). The beam members (42, 44) may be selectively inclinable either downwards or upwards towards the end abutting the first conveyor (60) by a jacking system (46) that raises one end of the beam member (42, 44) relative to the other end. The jacking system may either be hydraulic in nature or comprise electrically powered screw jacks. The second staging pipe rack (50) is substantially the same as the first staging pipe rack (40).

Figure 6:
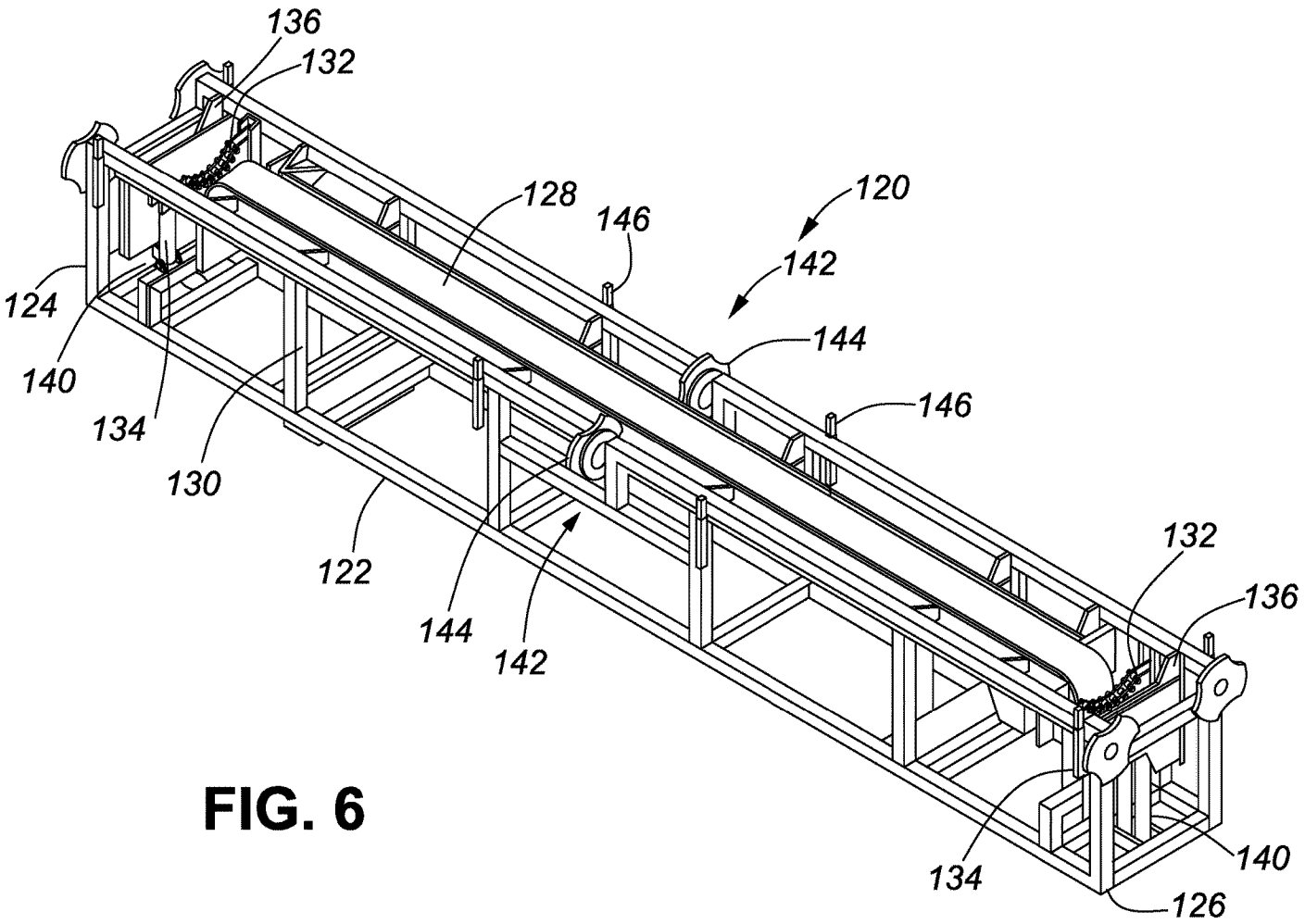
FIG. 6 is a perspective view of a pipe rack unit used in the system of the present disclosure.
Figure 7:
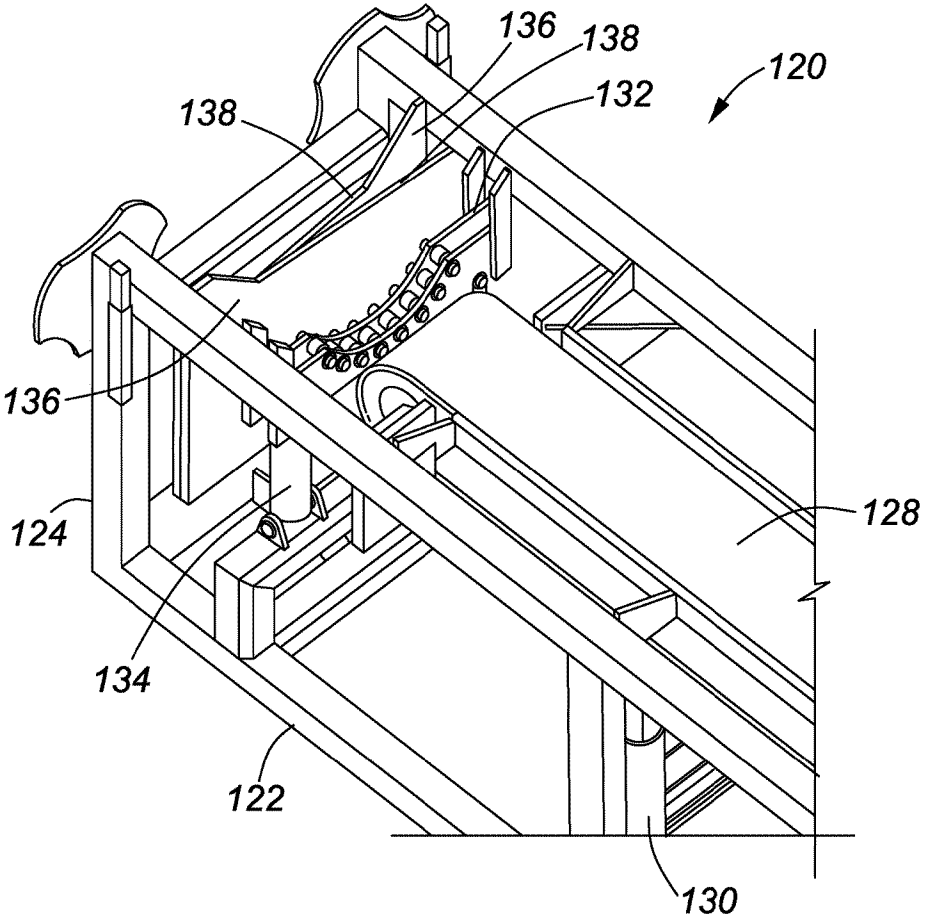
FIG. 7 is a perspective view of the end of the pipe rack unit shown in FIG. 6.

The first conveyor (60) and the second conveyor (70) move a first joint (J1) and a second joint (J2), respectively, into the bucking unit (80). In addition, the second conveyor (70) is reversible to move the tubular pipe segment (S) out of the bucking unit (80). In one embodiment, the first conveyor (60) has a length of at least a Range #2 tubular or a Range #3 tubular. In one embodiment, the second conveyor (70) has a length of least about twice a joint of standard length. In one embodiment, the second conveyor (70) has a length of at least about two Range #2 tubulars, a Range #2 tubular and a Range #3 tubular, or two Range #3 tubulars. In one embodiment as shown in the FIGS. 1 and 2, each of the first conveyor (60) and the second conveyor (70) are made of a plurality of detachable conveyor units (120) placed in end-to-end relation to each other. In one embodiment as shown in FIGS. 6 and 7, the conveyor unit (120) has an elongate frame (122) having a first end (124) and a second end (126) defining a longitudinal direction therebetween and a lateral direction perpendicular thereto. A powered belt (128) moves a joint (J1; J2) from the first end (124) to the second end (126) of the frame (122). The movement of the belt (128) can be reversed to move the joint (J1; J2) from the second end (126) to the first end (124) of the frame (122). A first jacking system (130), which may be either hydraulically or electrically driven, selectively varies the height of the belt (128) relative to the ground level (G). A pair of roller supports (132) at the first end (124) and the second end (126) of the frame (122) rotatably support the joint (J1; J2) when rotated by the bucking unit (80). A second jacking system (134), which may be hydraulically or electrically driven, selectively varies the height of the first and second roller supports (132) relative to the ground level (G). In the embodiment shown in FIGS. 6 and 7, each roller support (132) has an associated jack. Each conveyor unit has two pairs of kickers (136) that push the joint (J1, J2) transversely off of the belt (128) and the roller supports (132). In each pair of kickers (136), one of the kickers (136) is disposed at the first end (124) of the frame (122) and the other kicker (136) is disposed at the second end (126) of the frame (122). In the embodiment shown in the Figures, each of the kickers (136) is a metal plate having a transverse top edge (138) for engaging the joint (J1; J2). In each pair of kickers (136), the top edges (138) are downwardly inclined in the same transverse direction and in the opposite direction of the other pair of kickers (136). A third jacking system (140), which may be hydraulically or electrically driven, selectively varies the height of the kickers (136) relative to the ground level (G) so as that the top edge (138) alternately engages or disengages from the joint (J1; J2). When the top edge (138) engages a joint (J1; J2), the downward incline of the top edge (138) causes the joint (J1; J2) to roll transversely in the direction of the downward incline and off of the conveyor unit (122). An indexer (142) selectively allows a joint (J1; J2) to roll onto or off of the belt (128). In one embodiment as shown in the Figures, the indexer (142) comprises two sets of three rotatably driven sprocket-wheels (144) on each transverse side of the frame (122). Each of the sprocket-wheels (144) defines at least one trough configured to receive a joint (J1; J2). The rotation of the set of sprocket-wheels (144) on one transverse side of the frame (122) allows the pipe (J1; J2) to roll on or off of that side the conveyor unit (120). A plurality of pins (146) disposed on the perimeter of the frame (122) may be selectively raised and lowered to prevent or allow a joint (J1; J2) to roll transversely on and off of the conveyor unit (122). In other embodiments not shown, the kickers (136) and indexer (142) may vary in the number of their constituent plates or sprocket-wheels (144), as the case may be, or comprise other suitable devices known in the art.

The bucking unit (80) connects the threaded end connection of a first joint (J1) to a threaded connection of a second joint (J2), thus forming a tubular pipe segment (S). The bucking unit (80) may be any suitable apparatus known in the art that can connect two joints in this manner, many examples of which are commercially available. A suitable bucking unit for use with this invention is manufactured by McCoy™ Corporation (Houston, Tex.) as model RP 7018; other makes and models of bucking units may also be used. Such a bucking unit has a pair of closed-mouth clamping assemblies (82, 84) through which joints (J1; J2) can be fed. One of the clamping assemblies (82) engages a first joint (J1) and holds it stationary, while the other clamping assembly (84) engages a second joint (J2) and rotates it to screw the threaded end connections of the joints (J1; J2) together. The bucking unit (80) may be mounted on a jacking system to selectively adjust the height of the clamping assemblies (82, 84) relative to the ground level (G). In other embodiments of the system (10) not shown, the bucking unit (80) may be replaced by any suitable machine known in the art for connecting the joints (J1; J2) by their threaded end connections. Such machines may include, without limitation, power tongs, a mechanical roughneck, or powered or hydraulic tongs, or other machines for making up and breaking out joints, such as those manufactured and sold by Scorpion Oil Tools™ (Houston, Tex.).

The transfer pipe rack (90) supports a plurality of tubular pipe segments (S) made up by the bucking unit (80) until they are ready to be loaded on to the loading platform (24). In one embodiment as shown in the Figures, the transfer pipe rack (90) comprises four framed beam members (92) that are spaced apart and substantially parallel to each other and extend perpendicularly between one end that abuts the second conveyor (70) and another end that abuts the loading platform (24). In one embodiment, the spacing between the four beam members (92) of the transfer pipe rack (90) may be selected to support a tubular pipe segment (S) made of at least two standard length joints across the top of the beam members (92). In embodiments, the transfer pipe rack (90) may be configured to accommodate a tubular pipe segment made up from four Range #2 tubulars, or three Range #3 tubulars. The beam members (92) are inclined downwards towards an end that abuts the loading platform (24). The beam members (92) may be selectively inclinable either downwards or upwards towards the end abutting the loading platform (24) by means of a jacking system, which may be hydraulic or electrically driven, that raises one end of the beam member (92) relative to the other end. The beam members (92) may be substantially the same as the beam members that comprise the first and second staging pipe racks (40, 50).

The controller (110) may be operatively connected to one or more of the components (e.g. the belts, jacking systems, kickers, indexers, clamping assemblies) of the first staging pipe rack (40), the second staging pipe rack (50), the first conveyor (60), the second conveyor (70), the bucking unit (80), and the transfer pipe rack (90) to permit remote actuation these components. The controller (110) may be implemented by any suitable device known in the art that allows an operator to selectively and remotely actuate these components. The controller (110) may comprise electronic components, hydraulic components or a combination of electronic and hydraulic components. In one embodiment, the controller (110) may comprise a computer processor and a memory component storing a set of program instructions that dictate the actuation of one or more of the operatively connected components of the system, thereby allowing for automated or semi-automated operation of the system (10). In one embodiment, the controller (110) may be a wireless control box comprising a radio receiver and transceiver for wirelessly communicating with the operatively connected components.

The operation of one embodiment of the system (10) shown in FIGS. 1 and 2 when used to deliver a tubular pipe segment (S) from the ground level (G) to the rig floor (F) will now be described. The belts (128) and roller supports (132) or each of the conveyor units (120) of the first conveyor (60) and the second conveyor (70) are leveled using their jacking systems. A plurality of standard length first joints (J1) and second joints (J2) are staged on the first staging pipe rack (40) and the second staging pipe rack (50), respectively, ready to be made up in to tubular pipe segments (S). The jacking systems of the first and second staging pipe racks (40, 50) are actuated to downwardly incline the beam members (42, 52) towards the ends abutting the first conveyor (60) and the second conveyor (70), respectively, thus causing the joints (J1; J2) to roll towards the first and second conveyors (60, 70), respectively. The indexers (142) of the first and second conveyors (60, 70) selectively allow only one of the joints (J1; J2) to roll onto the belts (128) of the conveyor units (122). The jacking system of the bucking unit (80) adjusts the height of the clamping assemblies (82, 84) of the bucking unit (80) to receive the joints (J1; J2). The belts (128) advance the joints (J1; J2) into the clamping assemblies of the bucking unit (80). The bucking unit (80) connects the joints (J1; J2) by their threaded end connections to makeup a single tubular pipe segment (S). The belt (128) of the second conveyor (70) is reversed to remove the tubular pipe segment (S) from the bucking unit (80). The jacking system of the transfer pipe rack (90) is actuated to downwardly incline the transfer pipe rack towards the end abutting the loading platform (24). The indexer and kickers of the catwalk (20) selectively allow the tubular pipe segment (S) into the path of the powered delivery skate or conveyor (34). The delivery platform (22) is raised from the loading configuration as shown in FIG. 1 to the delivery configuration as shown in FIG. 2. The powered delivery skate (34) or conveyor pushes the tubular pipe segment (S) along the delivery platform (22) up to the rig floor (F) where it may be handled by workers for connection with the existing drill pipe. The above steps may be automated in a continuous and repeated workflow, thus providing a tubular pipe segments (S) to the rig floor (F) at a steady rate. In order to break down the tubular pipe segment and return joints (J1; J2) to the first staging pipe rack (40) and the second staging pipe rack (50), the steps as described above may be performed in reverse order.

In an embodiment disclosed the system (10), for example as shown in FIGS. 1 and 2 may be used to a deliver a tubular pipe segment (S), where that pipe segment (S) is a bottom hole assembly (BHA). The BHA may be a drilling BHA, completion BHA, or other BHA. With the tubular pipe segment (S) made up, it can be transferred into the path of the powered delivery skate or conveyor (34). However, if there is no clear path from the second conveyor (70) to the path of the powered delivery skate or conveyor (34), for example if there are tubulars on the transfer pipe rack (90), then the tubular pipe segment (S) may be transferred by other means, for example by using a front end loader or crane. If by front end loader, the operator could access the second conveyor (70) with the load at a first loader access (L1), and lift the tubular pipe segment (S) to a raised position. With the tubular pipe segment (S) in the raised position, the tubular pipe segment (S) may be transferred into the path of the powered delivery skate or conveyor (34) via a second loader access (L2).

Figure 3:
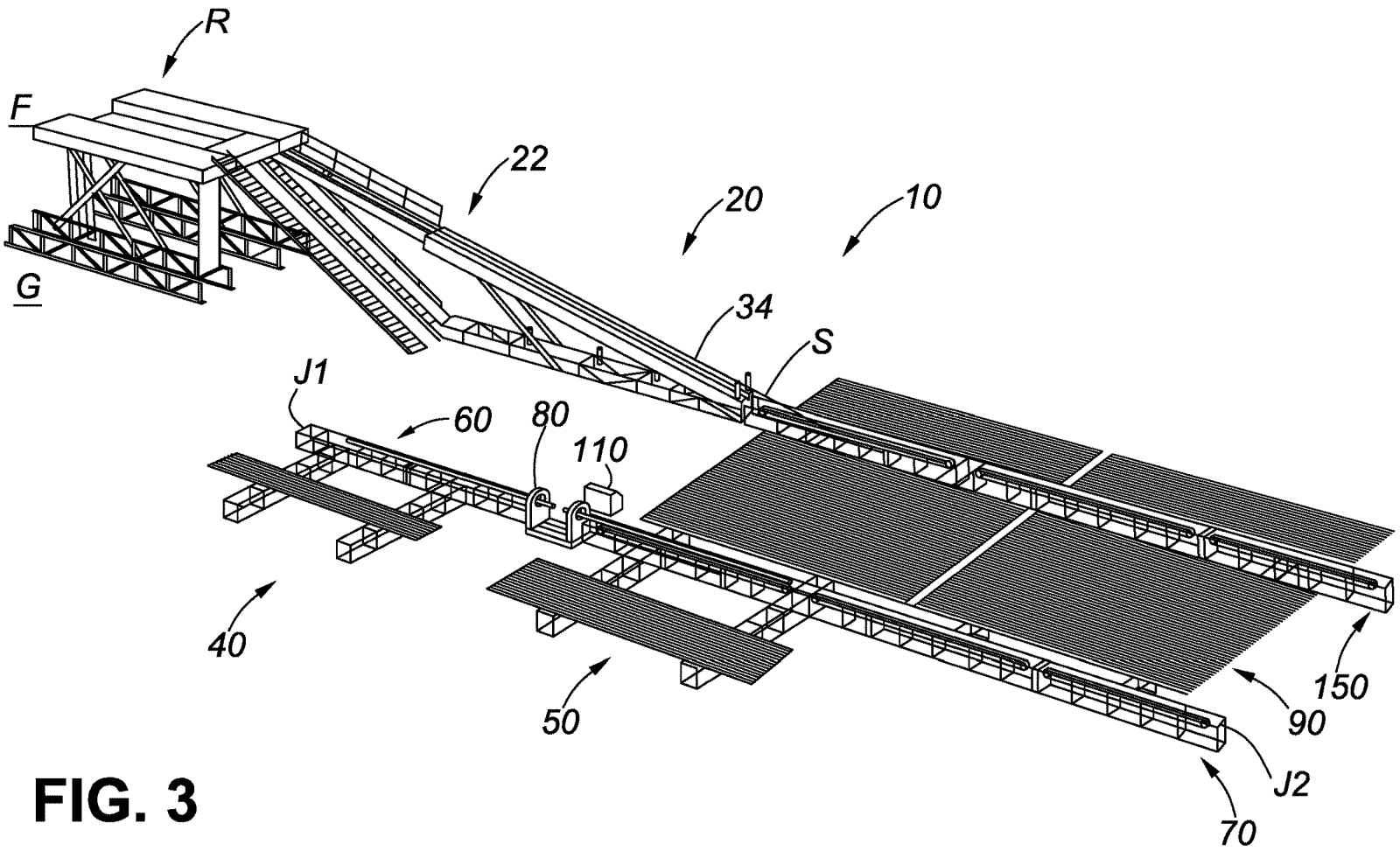
FIG. 3 is a perspective view of an alternative embodiment of the system of the present disclosure.
Figure 4A:
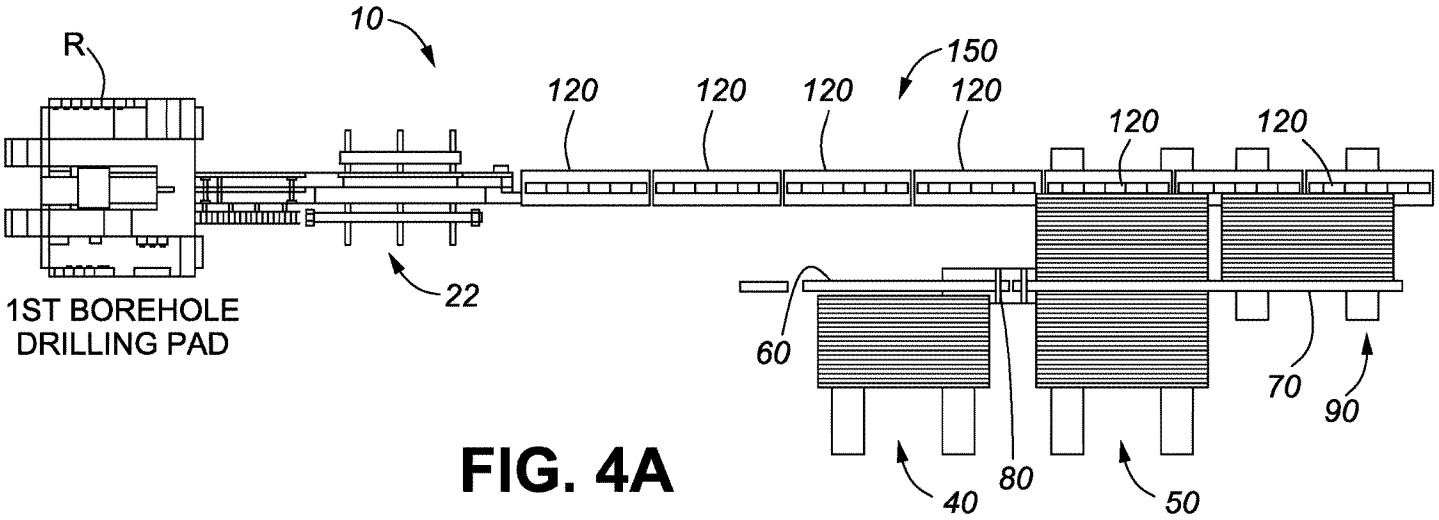
FIGS. 4A and 4B are top plan views of the embodiment of the system shown in FIG. 3 with the drilling rig positioned over a first borehole, and a second borehole, respectively.
Figure 4B:
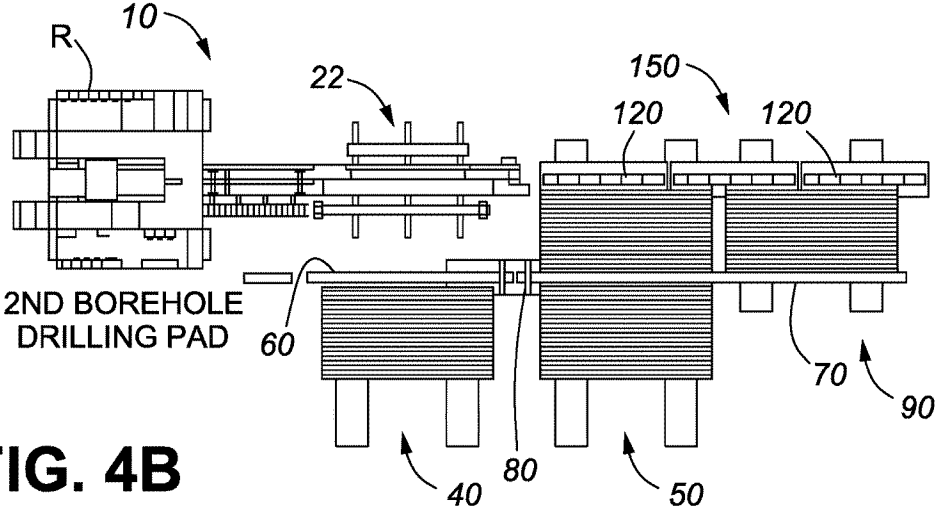

FIGS. 3, 4A, and 4B show an alternate embodiment of the system (10) of the present disclosure used at a site with multiple drilling pads. This embodiment of the system (10) is similar to the embodiment shown in FIGS. 1 and 2, except that the system (10) comprises a third conveyor (150) axially aligned with the delivery conveyor (34) of the catwalk (20). The third conveyor (150) comprises a plurality of axially aligned conveyor units (120), one embodiment of which is shown in FIGS. 6 and 7. The operation of this embodiment of the system (10) is similar to the operation of the embodiment of the system shown in FIGS. 1 and 2, except that the transfer pipe rack (90) loads the tubular pipe segment (S) onto the third conveyor (150) rather than onto a loading platform (24) of the catwalk (20). The third conveyor (150) pushes the tubular pipe segment (S) onto the axially aligned delivery conveyor (34) of the catwalk (20). This embodiment of the system (10) permits a tubular pipe segment (S) of a given length to be moved up to the rig floor (F) with a shorter delivery platform (22) that would be necessary with the embodiment of the system (10) shown in FIGS. 1 and 2, since the third conveyor (150) effectively extends the length of the delivery platform (22). The system (10) may be set up to deliver tubular pipe segments (S) to the rig floor (F) when the rig (R) is positioned over a first drilling pad as shown in FIG. 4A. When the rig (R) is ready to be moved over a second drilling pad, the length of the third conveyor (150) is shortened by removing one or more of its constituent conveyor units (120). The collective length of the removed conveyor units (120) is selected to correspond the spacing between the first and second boreholes. In one embodiment, the length of a single conveyor unit (120) is selected to correspond the spacing between boreholes of adjacent drilling pads. Therefore, when the rig (R) is advanced to the second drilling pad and properly positioned over its borehole, the end of its delivery platform (22) abuts the end of the shortened third conveyor (150), as shown in FIG. 4B. Conversely, if the rig (R) is being moved away staging pipe racks (40, 50), for example from the second drilling pad as shown in FIG. 4B to the first drilling pad as shown in FIG. 4A, then conveyor units (120) can be added to the end of the third conveyor (150) to lengthen the third conveyor (150) until its end abuts the delivery platform (22).

Figure 5A:
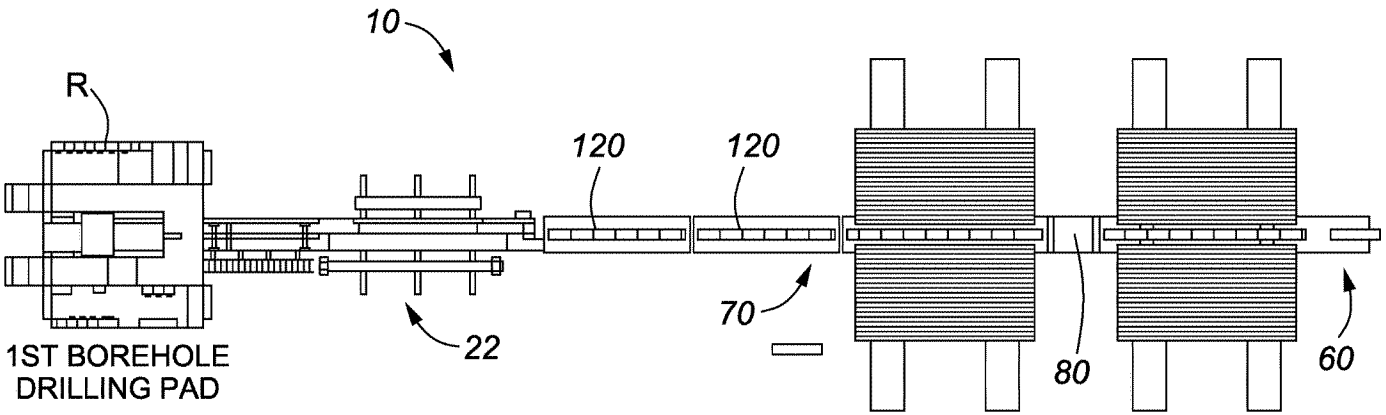
FIGS. 5A and 5B are top plan views of an alternative embodiment of the system of the present disclosure with the drilling rig positioned over a first borehole, and a second borehole, respectively.
Figure 5B:
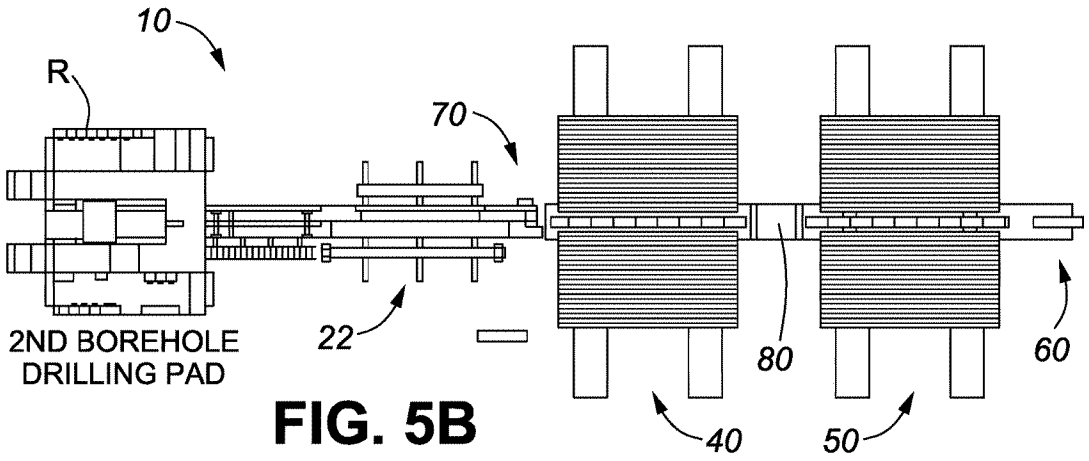

FIGS. 5A and 5B show an alternate embodiment of the system (10) of the present disclosure. This embodiment of the system (10) is similar to the embodiment shown in FIGS. 3, 4A and B, except that the transfer pipe rack (90) and the third conveyor (150) are omitted, and the second conveyor (70) is axially aligned with the delivery conveyor (34) of the catwalk (20). The operation of this embodiment of the system (10) is similar to the operation of the embodiment of the system shown in FIGS. 3, 4A, and 4B except that the second conveyor (70) is used to push the tubular pipe segment (S) onto the axially aligned delivery conveyor (34) of the catwalk (20). The system (10) may be set up to deliver tubular pipe segments (S) to the rig floor (F) when the rig (R) is positioned over a first drilling pad as shown in FIG. 5A. When the rig (R) is ready to be moved over a second drilling pad, the length of the second conveyor (70) may be shortened by removing one or more of its constituent conveyor units (120). The collective length of the removed conveyor units (120) is selected to correspond to the spacing between the borehole of the first and second drilling pad. In one embodiment, the length of a single conveyor unit (120) is selected to correspond the spacing between boreholes of adjacent drilling pads. Therefore, when the rig (R) is advanced to the second drilling pad and properly positioned over its borehole, the end of its delivery platform (22) abuts the end of the shortened second conveyor (70), as shown in FIG. 5B. Conversely, if the rig (R) is being moved away staging pipe racks (40, 50), for example from the second drilling pad as shown in FIG. 5B to the first drilling pad as shown in FIG. 5A, then conveyor units (120) can be added to the end of the second conveyor (70) to lengthen the second conveyor (70) until its end abuts the delivery platform.

As described herein, the conveyors include belts on roller supports, for example belt (128) and roller supports (132). However, in an embodiment disclosed, the respective conveyors may include roller supports, which are driven for example by hydraulic, pneumatic, or electric motors. The roller supports would have a concave face to cradle or centre the tubular and a friction material, for example rubber. The conveyors shown, including belts and roller supports are preferred. The conveyor belts shown may be driven by hydraulic, pneumatic, or electric motors.

Figure 8:
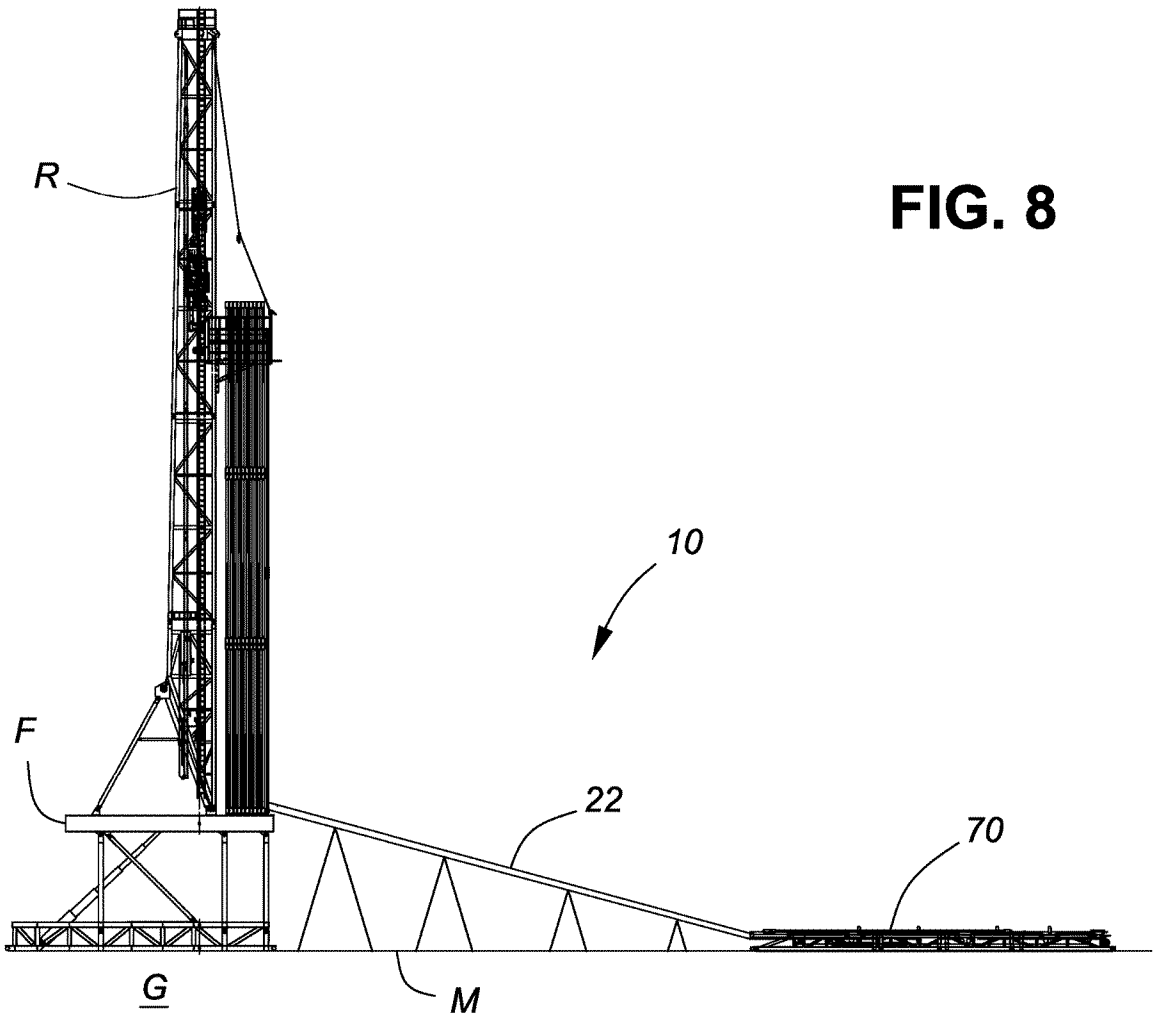
FIG. 8 is a side elevation view of an alternative embodiment of the system of the present disclosure.

FIG. 8 shows an alternative embodiment of the system (10) of the present disclosure. In this embodiment, which is similar to that shown in FIGS. 5A and 5B, the delivery platform (22) is provided by a regular conveyor belt system that sits on top of the matting (M) at the ground level (G). No catwalk (20) is required. The second conveyor (70) may be any suitable conveyor system known in the art, or it may comprise a plurality of conveyor units (120) such as shown in FIGS. 6 and 7.

Figure 9:
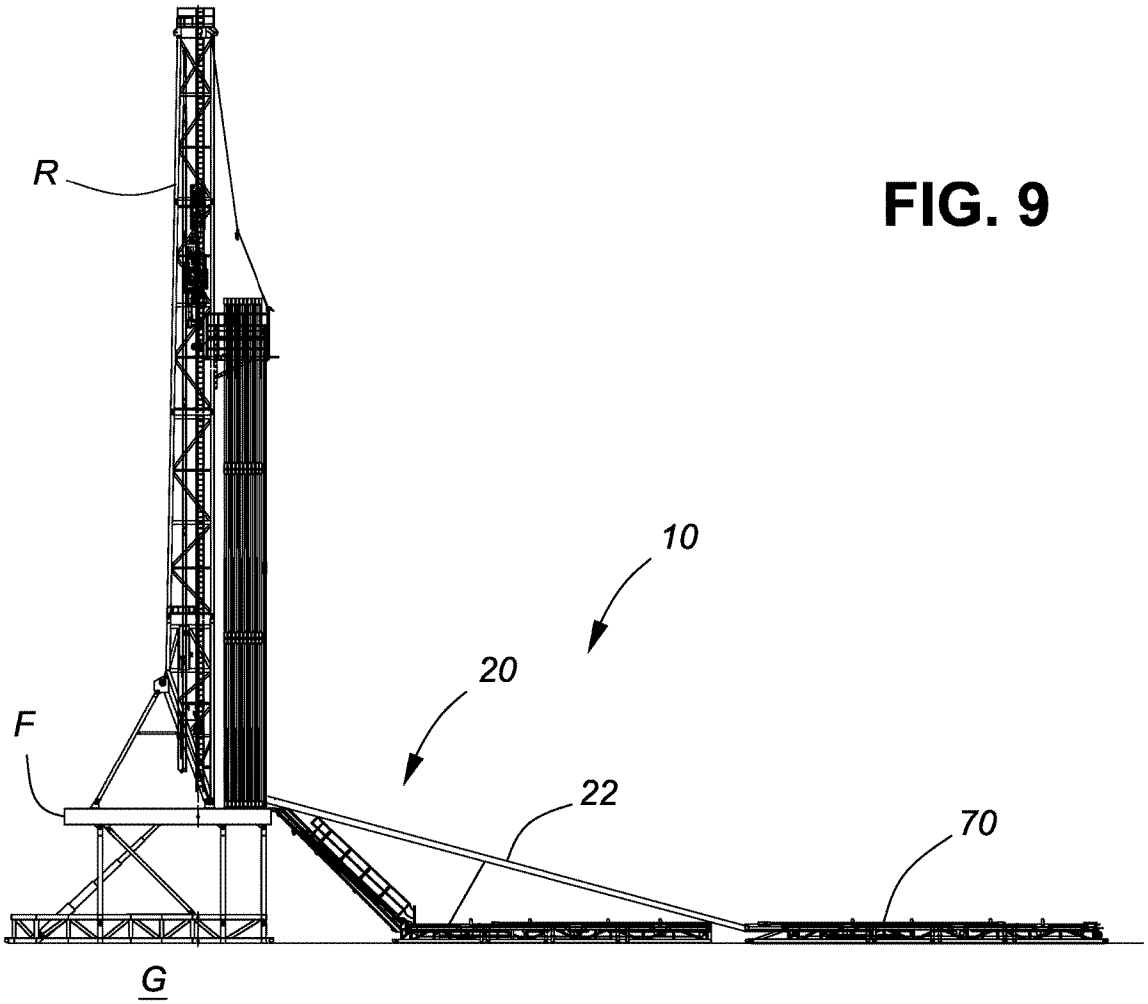
FIG. 9 is a side elevation view of an alternative embodiment of the system of the present disclosure.

FIG. 9 shows an alternative embodiment of the system (10) of the present disclosure. In this embodiment, which is similar to that shown in FIGS. 5A and 5B, the delivery platform (22) is provided on a conventional catwalk (20) that folds in half for transport. Any suitable catwalk (20) known in the art may be adapted with the delivery platform (22). The second conveyor (70) may be any suitable conveyor system known in the art, or it may comprise a plurality of conveyor units (120) such as shown in FIGS. 6 and 7.

It will be appreciated that the system (10) and method as described above, may be used to minimize the amount of handling and lifting of joints (J1, J2) between the ground level (G) and the rig floor (F). Once the joints (J1; J2) are supported on the first staging rack (40), and second staging rack (50), respectively, it is unnecessary to lift them to transfer them onto the delivery platform (22). Further, it will be appreciated that making up the tubular pipe segment (S) with a bucking unit (80) at the ground level (G) may allow for greater control over this process, and thereby reduce the risk of making a "bad joint" compared to making up the drill pipe using roughnecking operations at the rig floor (F). Further still, it will be appreciated that, for a given length of drill pipe, making up the tubular pipe segment (S) with two standard length joints (J1; J2) at ground level (G) reduces the number of delivery cycles that have to be made by the pipe lifting apparatus (20) to the rig floor (F) and reduces the number of roughnecking operations that have to be performed by workers at the rig floor (F).

In will be appreciated that the system (10) can be used for faster and safer casing operations, in comparison to conventional systems. For example, any necessary centralizers and stop collars can be installed on the joints while they are on the staging pipe racks. Therefore, workers on the rig floor do not have to install the centralizers and stop collars in a potentially hazardous overhead configuration.

It will be appreciated that the system (10) can be used for faster and safer handling and transfer of bottom hole assemblies (BHA's). For example, when a first BHA is being run out of the borehole, a second BHA can be prepared for running into the borehole. In addition, since the BHA can be assembled before being run into the borehole, it can be properly "torqued up" prior to being suspended from an elevator on the rig floor. This reduces the risk that a pick-up sub or a loose joint might come undone and fall towards the rig floor or down into the borehole.

It will also be appreciated that the modular construction of the components of the system (10) allows the system (10) to be adapted to suit a variety of well site environments. For example, additional beam elements can be added and spaced apart from the joints (42, 44) of the first staging pipe rack to store longer joints (J1). The length of the beam elements (42, 44) can be increased to store a larger number of joints (J1). The movement of a mobile rig (R) along a row of drilling pads can be accommodated by adding or removing conveyor units (120) to the conveyors (70, 150). This allows the staging pipe racks (40, 50) to remain stationary, which is safer than having to move the staging pipe racks (40, 50) with the rig (R). This also allows the staging pipe racks (40, 50) to be located in a casing yard located far away from the rig (R), which provides greater clearance around the rig (R) for workers, vehicles and equipment than if the staging pipe racks (40, 50) were positioned adjacent to the rig (R). The bucking unit (80) can be positioned on either side of the delivery platform (22) of the catwalk (20), or in line with the delivery platform (22) of the catwalk, thus providing even further flexibility for the system (10).

The above-described embodiments are intended to be examples only. Alterations, modifications and variations can be effected to the particular embodiments by those of skill in the art without departing from the scope, which is defined solely by the claims appended hereto.

What is claimed is:

1. A system for delivering a tubular pipe segment from a ground level to an elevated drill rig floor, the tubular pipe segment comprising at least a first joint and a second joint connected end-to-end, the system comprising:

(a) an inclined delivery conveyor or a skate extending from the ground level to the rig floor, wherein the delivery conveyor or skate comprises a loading portion that is inclinable from a substantially horizontal orientation at the ground level;

(b) a pipe assembly system based at the ground level and comprising:

(i) a bucking unit for connecting the first joint and the second joint by their threaded end connections to form the tubular pipe segment;

(ii) a powered first conveyor for moving the first joint into the bucking unit;

(iii) a first staging pipe rack for storing a plurality of joints comprising the first joint and inclined downwards towards an end abutting the first conveyor;

(iv) a powered second conveyor for moving the second joint into the bucking unit, and reversible for moving the tubular pipe segment out of the bucking unit;

(v) a second staging pipe rack for storing a plurality of joints comprising the second joint and inclined downwards towards an end abutting the second conveyor; and (vi) a transfer pipe rack for storing a plurality of tubular pipe segments including the tubular pipe segment and inclined downwards from a first end abutting the second conveyor to a second end abutting the loading portion of the delivery skate or conveyor when the loading portion is horizontally oriented at the ground level, wherein the first conveyor or the second conveyor or both comprise:

an elongate frame for supporting the conveyor on a ground level, the frame having a first end and a second end, the first and second end defining a longitudinal direction and a lateral direction perpendicular thereto;

a powered roller for moving a joint aligned longitudinally from the first end to the second end of the frame, and a first jacking system for selectively varying the height of the powered roller relative to the ground level;

a first roller support for rotatably supporting the joint and disposed at the first end of the frame, a second roller support for rotatably supporting joint pipe and disposed at the second end of the frame, and a second jacking system for selectively varying the height of the first and second roller supports relative to the ground level;

at least one pair of kickers for pushing the joint transversely off of the conveyor and the first roller support, wherein one of the kickers is disposed at the first end of the frame and the other kicker is disposed at the second end of the frame, and a third jacking system for selectively varying the height of the kickers relative to the ground level; and an indexer for selectively allowing the pipe to roll transversely onto or off of the conveyor, the indexer comprising at least one sprocket-wheel rotatably attached to the frame and disposed transversely adjacent to the powered roller, wherein the sprocket-wheel defines at least one trough configured to receive the pipe.

2. The system of claim 1, wherein the powered roller further comprises a conveyor belt.

3. The system of claim 2 further comprising a controller operatively connected with one or more of the belts, jacking systems, kickers, indexers, clamping assemblies of the first staging pipe rack, the second staging pipe rack, the first conveyor, the second conveyor, the bucking unit, and the transfer pipe rack to permit selective and remote actuation these components.

4. The system of claim 3, wherein the controller comprises a computer processor and a memory component storing a set of program instructions that dictate the actuation of one or more of the operatively connected components of the system, thereby allowing for automated or semi-automated operation of the system.

5. The system of claim 4, the controller comprising a wireless control box comprising a radio receiver and transceiver for wirelessly communicating with the operatively connected components.

6. The system of claim 1, wherein the tubular pipe segment comprises a bottom hole assembly (BHA).

7. A system for delivering a tubular pipe segment from a ground level to an elevated drill rig floor, the tubular pipe segment comprising a first joint and a second joint connected by their threaded end connections, the system comprising:

(a) an inclined delivery conveyor or a skate extending from the ground level to the rig floor;

(b) a pipe assembly system based at the ground level and comprising:

(i) a bucking unit for connecting the first joint and the second joint by their threaded end connections to form the tubular pipe segment;

(ii) a powered first conveyor for moving the first joint into the bucking unit;

(iii) a first staging pipe rack for storing a plurality of joints comprising the first joint and inclined downwards towards an end abutting the first conveyor;

(iv) a powered second conveyor for moving the second joint into the bucking unit, and reversible for moving the tubular pipe segment out of the bucking unit;

(v) a second staging pipe rack for storing a plurality of joints comprising the second joint and inclined downwards towards an end abutting the second conveyor;

(vi) a powered third conveyor axially aligned with the delivery skate or conveyor for moving the tubular pipe segment onto the delivery skate or conveyor; and (vii) a transfer pipe rack for storing a plurality of tubular pipe segments including the tubular pipe segment and inclined downwards from a first end abutting the second conveyor to a second end abutting the third conveyor, wherein the first conveyor, the second conveyor, or the third conveyor, or combinations thereof comprise:

an elongate frame for supporting the conveyor on a ground level, the frame having a first end and a second end, the first and second end defining a longitudinal direction and a lateral direction perpendicular thereto;

a powered roller for moving a joint aligned longitudinally from the first end to the second end of the frame, and a first jacking system for selectively varying the height of the powered roller relative to the ground level;

a first roller support for rotatably supporting the joint and disposed at the first end of the frame, a second roller support for rotatably supporting joint pipe and disposed at the second end of the frame, and a second jacking system for selectively varying the height of the first and second roller supports relative to the ground level;

at least one pair of kickers for pushing the joint transversely off of the powered roller and the first roller support, wherein one of the kickers is disposed at the first end of the frame and the other kicker is disposed at the second end of the frame, and a third jacking system for selectively varying the height of the kickers relative to the ground level; and an indexer for selectively allowing the pipe to roll transversely onto or off of the powered roller, the indexer comprising at least one sprocket-wheel rotatably attached to the frame and disposed transversely adjacent to the powered roller, wherein the sprocket-wheel defines at least one trough configured to receive the pipe.

8. The system of claim 7, wherein the powered roller further comprises a conveyor belt.

9. The system of claim 8, further comprising a controller operatively connected with one or more of the belts, jacking systems, kickers, indexers, clamping assemblies of the first staging pipe rack, the second staging pipe rack, the first conveyor, the second conveyor, the bucking unit, and the transfer pipe rack to permit selective and remote actuation these components.

10. The system of claim 9, wherein the controller comprises a computer processor and a memory component storing a set of program instructions that dictate the actuation of one or more of the operatively connected components of the system, thereby allowing for automated or semi-automated operation of the system.

11. The system of claim 10, the controller comprising a wireless control box comprising a radio receiver and transceiver for wirelessly communicating with the operatively connected components.

12. The system of claim 7, wherein the tubular pipe segment comprises a bottom hole assembly (BHA).

13. A system for delivering a tubular pipe segment from a ground level to an elevated drill rig floor, the tubular pipe segment comprising a first joint and a second joint connected by their threaded end connections, the system comprising:

(a) an inclined delivery conveyor or a skate extending from the ground level to the rig floor;

(b) a pipe assembly system based at the ground level and comprising:

(i) a bucking unit for connecting the first joint and the second joint by their threaded end connections to form the tubular pipe segment;

(ii) a powered first conveyor for moving the first joint into the bucking unit;

(iii) a first staging pipe rack for storing a plurality of joints comprising the first joint and inclined downwards towards an end abutting the first conveyor;

(iv) a powered second conveyor for moving the second joint into the bucking unit, wherein the second conveyor is reversible and axially aligned with the delivery skate or conveyor for moving the tubular pipe segment out of the bucking unit and onto the delivery skate conveyor; and (v) a second staging pipe rack for storing a plurality of joints comprising the second joint and inclined downwards towards an end abutting the second conveyor, wherein the first conveyor or the second conveyor or both comprise:

an elongate frame for supporting the conveyor on a ground level, the frame having a first end and a second end, the first and second end defining a longitudinal direction and a lateral direction perpendicular thereto;

a powered roller for moving a joint aligned longitudinally from the first end to the second end of the frame, and a first jacking system for selectively varying the height of the powered roller relative to the ground level;

a first roller support for rotatably supporting the joint and disposed at the first end of the frame, a second roller support for rotatably supporting joint pipe and disposed at the second end of the frame, and a second jacking system for selectively varying the height of the first and second roller supports relative to the ground level;

at least one pair of kickers for pushing the joint transversely off of the powered roller and the first roller support, wherein one of the kickers is disposed at the first end of the frame and the other kicker is disposed at the second end of the frame, and a third jacking system for selectively varying the height of the kickers relative to the ground level; and an indexer for selectively allowing the pipe to roll transversely onto or off of the powered roller, the indexer comprising at least one sprocket-wheel rotatably attached to the frame and disposed transversely adjacent to the powered roller, wherein the sprocket-wheel defines at least one trough configured to receive the pipe.

14. The system of claim 13, wherein the powered roller further comprises a conveyor belt.

15. The system of claim 14, further comprising a controller operatively connected with one or more of the belts, jacking systems, kickers, indexers, clamping assemblies of the first staging pipe rack, the second staging pipe rack, the first conveyor, the second conveyor, the bucking unit, and the transfer pipe rack to permit selective and remote actuation these components.

16. The system of claim 15, wherein the controller comprises a computer processor and a memory component storing a set of program instructions that dictate the actuation of one or more of the operatively connected components of the system, thereby allowing for automated or semi-automated operation of the system.

17. The system of claim 16, the controller comprising a wireless control box comprising a radio receiver and transceiver for wirelessly communicating with the operatively connected components.

18. The system of claim 13, wherein the tubular pipe segment comprises a bottom hole assembly (BHA).

* * * * *